US010901348B1

(12) United States Patent
Buchanan et al.

(10) Patent No.: US 10,901,348 B1
(45) Date of Patent: Jan. 26, 2021

(54) FUSER ASSEMBLY HAVING OPENABLE FUSING NIP UPON OPENING AN ACCESS DOOR OF IMAGING DEVICE

(71) Applicant: LEXMARK INTERNATIONAL, INC., Lexington, KY (US)

(72) Inventors: Jeffery James Buchanan, Lexington, KY (US); Peter Alden Bayerle, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/663,455

(22) Filed: Oct. 25, 2019

(51) Int. Cl.
*G03G 15/20* (2006.01)
*G03G 21/16* (2006.01)

(52) U.S. Cl.
CPC ..... *G03G 15/2028* (2013.01); *G03G 21/1633* (2013.01); *G03G 2215/00413* (2013.01)

(58) Field of Classification Search
CPC ..... G03G 15/2028; G03G 15/2032; G03G 15/2035; G03G 21/1633; G03G 21/1638; G03G 2215/00413
See application file for complete search history.

(56) References Cited

U.S. PATENT DOCUMENTS 6,125,256 A 9/2000 Ni et al.
7,003,246 B2 2/2006 Gogate et al.
10,310,421 B1 6/2019 Buchanan
2006/0002737 A1 1/2006 Shinshi
2007/0077104 A1* 4/2007 Hasegawa ..... G03G 21/1638 399/328
2008/0181686 A1 7/2008 Geyling et al.
2008/0310895 A1 12/2008 Masuda et al.
2009/0232549 A1 9/2009 Foster et al.
2011/0170920 A1 7/2011 Fujiwara et al.
2012/0082478 A1 4/2012 Wang
2017/0090373 A1 3/2017 Hashimoto et al.

OTHER PUBLICATIONS

Pictures of Fuser Bellcrank; Samsung Printer Model: Xpress M3015DW; 2pp.;printer publicly available at least as of application filing date Dec. 6, 2017.

* cited by examiner

*Primary Examiner* — Hoang X Ngo

(57) ABSTRACT

A fuser assembly includes a heated member and backup member forming a fusing nip. Nip loading springs on either ends of the fusing nip bias into contact the backup member and the heated member. Bellcranks contact the nip loading springs. Rotatable latches on either ends of the fusing nip act on the bellcranks to compress or relax the nip loading springs to open or close the fusing nip at respective distal or proximate ends of the fuser assembly. The rotatable latches are acted upon by corresponding latches of an access door of an imaging device that when opened provides access to the fuser assembly in an interior of the imaging device. The rotatable latches are independently movable. They can reside in different positions, yet allow closing the door of the imaging device.

21 Claims, 11 Drawing Sheets

FUSER ASSEMBLY HAVING OPENABLE FUSING NIP UPON OPENING AN ACCESS DOOR OF IMAGING DEVICE

FIELD OF THE INVENTION

The present disclosure relates to a fuser assembly in an imaging device. The assembly includes a heated and backup member forming a fusing nip. The disclosure relates further to opening the fusing nip upon opening an access door of the imaging device.

BACKGROUND

In the electrophotographic (EP) imaging process in printers, copiers and the like, a photosensitive drum or belt is uniformly charged over an outer surface. An electrostatic latent image is formed by selectively discharging the surface and applying toner. The toner is transferred to media and fixed by applying heat and pressure in a fusing nip of a fuser assembly.

Fuser assemblies take many forms. They include hot rolls or belts that springs bias against a backup roll to form a fusing nip. The nip exerts a force on media traversing the nip, but requires opening to effectively clear media jams. Most devices require a user to open an access door of the imaging device and, once inside, manipulate the fuser assembly to open the nip. The inventors recognize a need to overcome this multi-step process.

SUMMARY

A fuser assembly includes a heated member and backup member forming a fusing nip. A nip loading spring biases into contact the backup member and the heated member. A bellcrank contacts the nip loading spring. A rotatable latch acts on the bellcrank to compress or relax the nip loading spring to open or close the fusing nip upon opening or closing an access door of the imaging device. The rotatable latch is acted upon by a latch of the access door that, when opened, provides access to the fuser assembly in an interior of the imaging device for removal of paper jams, for example. The rotatable latch resides in open or closed positions but each allows closing the door of the imaging device. The symmetry of the fuser assembly facilitates duplicate features on proximate and distal ends of the fusing nip.

DETAILED DESCRIPTION OF THE EMBODIMENTS

Figure 1:
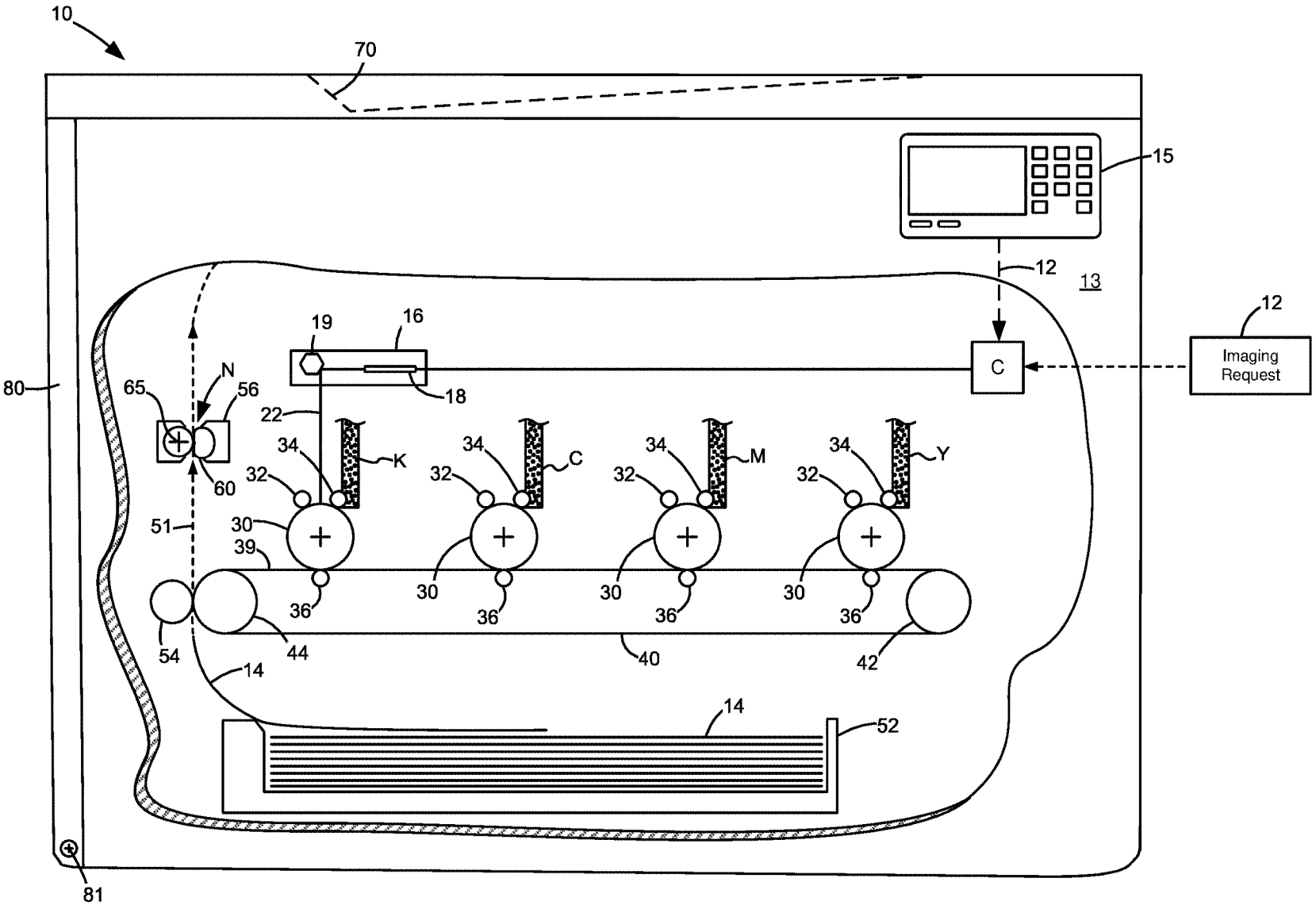
FIG. 1 is a diagrammatic view of an imaging device with a fusing nip openable upon opening of an access door.

FIG. 1 teaches an imaging device 10 that receives at a controller (C) a request 12 for imaging media. The request comes externally to a housing 13 of the imaging device, such as from a computer, laptop, smart phone, fax machine, server, cloud connection, etc. It also comes internally, such as from a user interface 15. In any, the controller converts the request to appropriate signals for providing to a laser scan unit 16. The unit turns on and off a laser 18 according to pixels of the imaging request. A rotating mirror 19 and associated lenses, reflectors, etc. (not shown) focus a laser beam 22 onto one or more photoconductive drums 30, as is familiar. The drums correspond to supplies of toner, such as black (K) and one or more colored toners, such as cyan (C), magenta (M) and yellow (Y). A corona or charge roller 32 sets a charge on a surface of the drums 30 as the drums rotate. The laser beam 22 electrostatically discharges the drums to create an electrostatic latent image. A developer roller 34 introduces toner to the latent image and such is electrostatically attracted to create a toned image on a surface of the drums. A voltage differential between the surface of the drums 30 and transfer rolls 36 causes transfer of the toned image from the drums to a surface 39 of an intermediate transfer member (ITM) 40.

The ITM 40, being entrained about a drive roll 42 and one or more idler/tension rolls 44, moves in a process direction with the surface of the drums. A sheet of media 14 advances in a path of media travel 51 from a tray 52 to a transfer roll 54 where a second difference in voltage between the ITM and the transfer roll 54 causes the toned image to attract and transfer to a surface of the media 14. A fuser assembly 56 fixes the toned image to the media through application of heat and pressure in a fusing nip (N) formed by a heated member 60 and a backup member 65. Users pick up the media from a bin 70 after it advances out of the imaging device. The controller coordinates the operational conditions that facilitate the timing of the image transfer and transportation of the media from tray to bin. Also, a door 80 connects to the imaging device to allow access to an interior of the housing 13. Customers open the door to clear paper jams in the fusing nip or path of media travel, for example, or undertake maintenance on customer replaceable units, such as the fuser assembly 56. In one embodiment, the door rotates open and closed by way of a hinge 81. Upon opening, the fusing nip N opens and vice versa.

Figure 2:
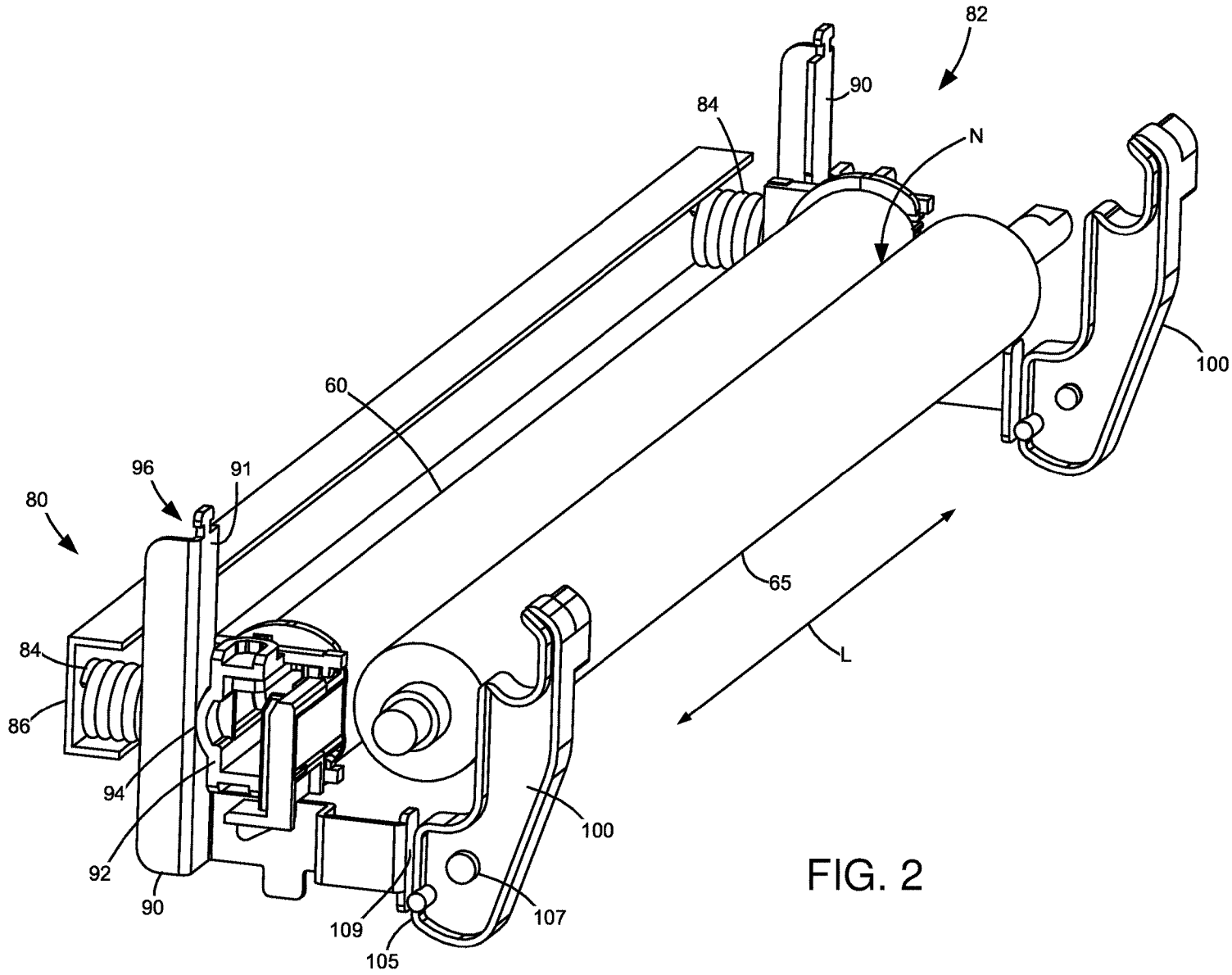
FIG. 2 is a simplified diagrammatic view of a fusing nip in a fuser assembly, including heated and backup members defining a longitudinal extent with distal and proximate ends that locate end caps, nip loading springs, bellcranks and rotatable latches that act to open and close the fusing nip upon opening and closing of the access door.
Figure 3:
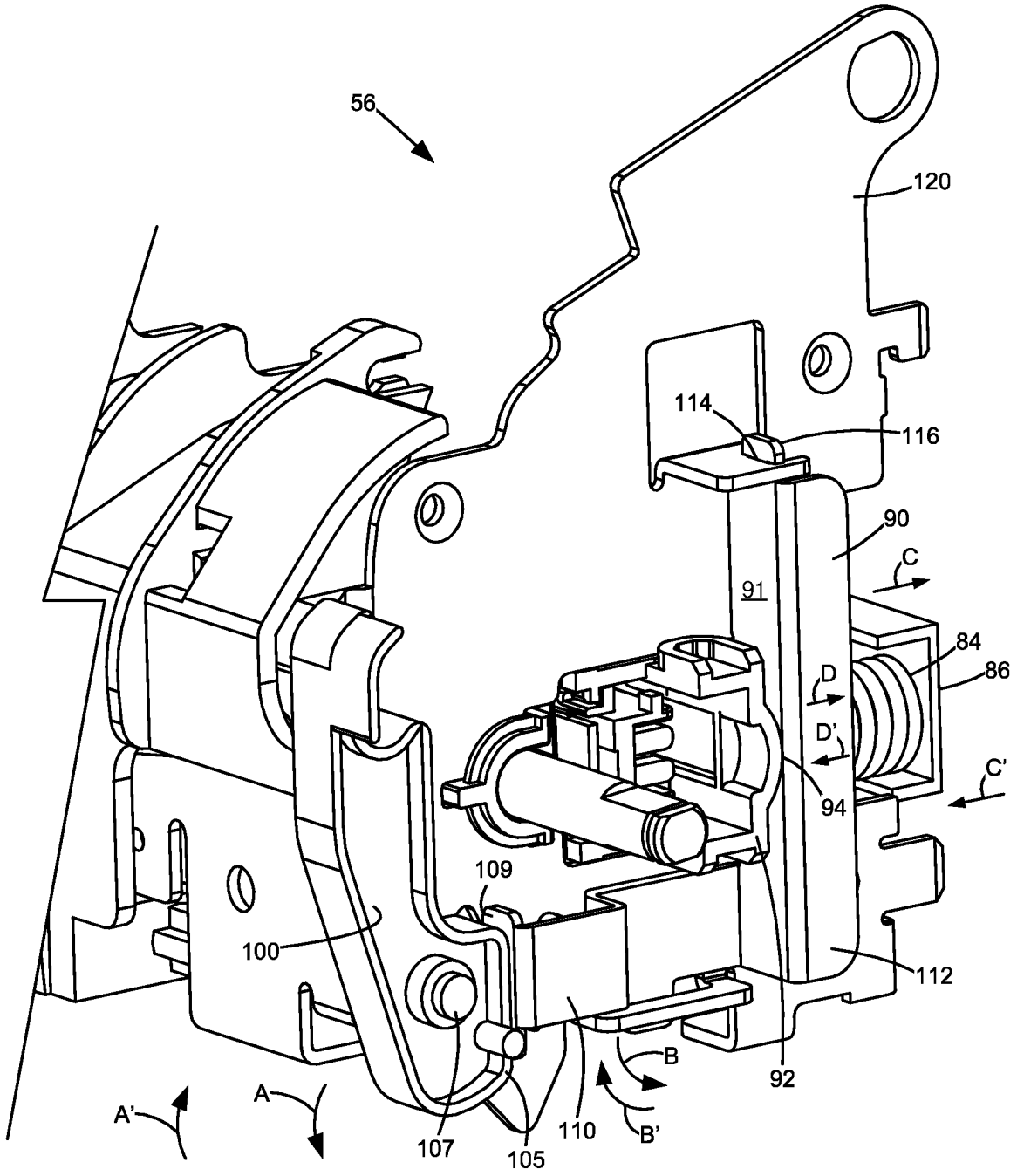
FIG. 3 is a diagrammatic view of a fuser assembly.

With reference to FIGS. 2 and 3, the heated member 60 and the backup member 65 define an axis of rotation along a longitudinal extent (L) of the fusing nip N extending from a proximate end 80 to a distal end 82. In one embodiment, the heated member typifies a multi-layered polymeric belt with internal heating lamp or ceramic heater/resistive traces, as is familiar. Alternatively, the heated member typifies defines a hot roll, such as a metal core with coating(s) exhibiting good thermal mass, and a heating lamp internal to the core, as is also familiar. The backup member 65, on the other hand, typifies a microballoon (e.g., porous foam rubber) or a liquid-injection-molded rubber roll. Either the heated or backup member connects to a motor (not shown)

which, when activated, causes rotation of the other member to convey media through the fusing nip in the process direction.

To maintain the pressure of the fusing nip, nip loading springs 84 are provided to press into contact the heated and backup members. At both the distal and proximate ends, the springs maintain uniformity of force of the fusing nip throughout an axial length of the nip during use. On one end of the nip loading springs is a fixed plate 86 that connects to the fuser assembly while on the other end is a surface 96 of a bellcrank 90. Between the plate and the bellcrank the nip loading spring is compressed. On an opposite surface 91 of the bellcrank, at contact point 94, the bellcranks 90 press against end caps 92. That the end caps connect to terminal ends of the heated member 60, in a manner which allows the heated member to rotate, the heated member presses into contact with the backup member by action of the nip loading springs.

Figure 4A:
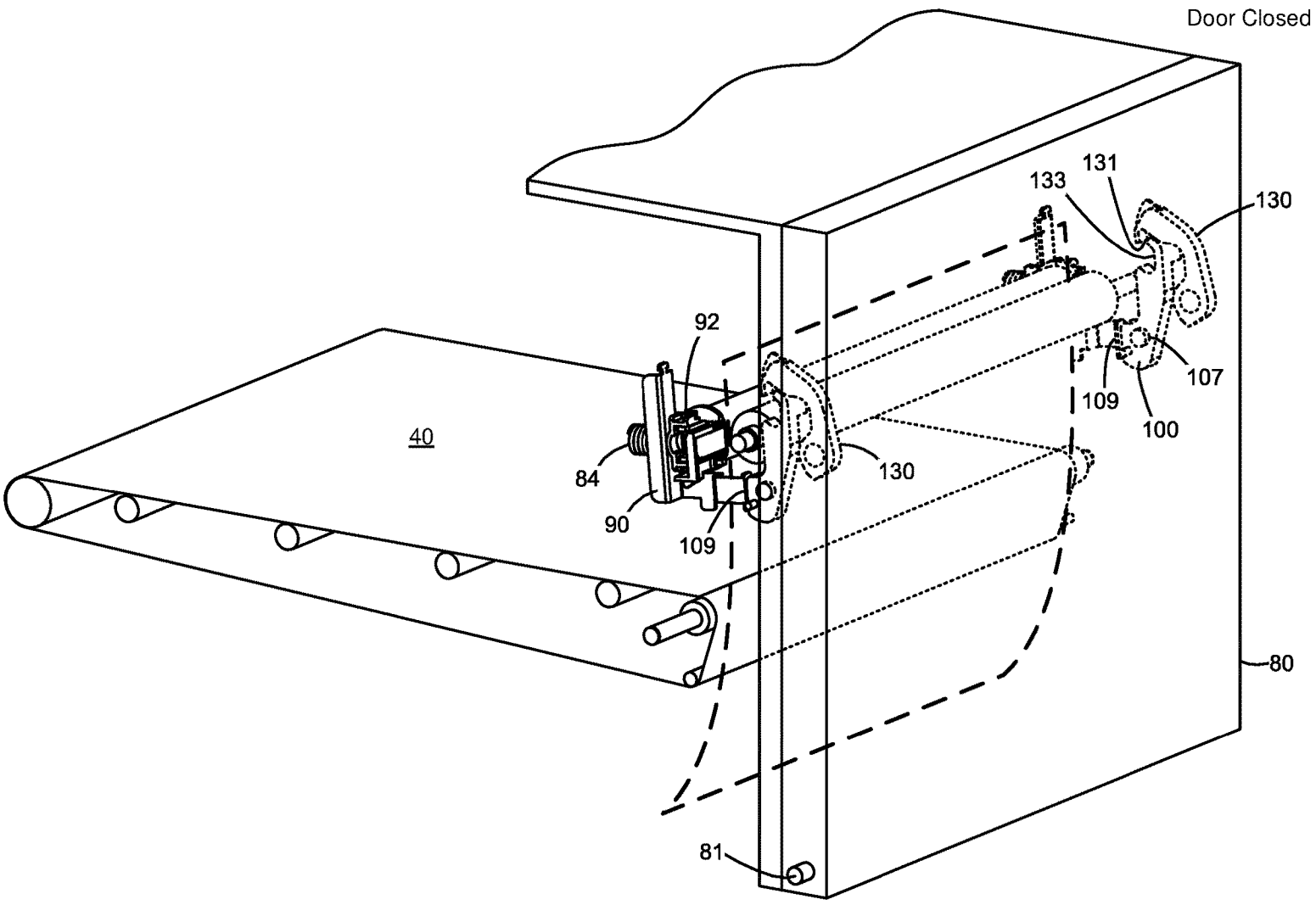
FIGS. 4A and 4B are diagrammatic views showing action of the fusing nip upon closed and open conditions of the access door, including rotatable latches of the fuser assembly acted upon by door latches.

Also, at either ends of the fusing nip, fuser latches 100 reside nearby the bellcranks to act on the bellcranks to open the fusing nip upon opening or closing the access door of the imaging device. As seen in the sequential views of FIGS. 4A and 4B, door latches 130 have hooks 131 corresponding to hooks 133 of the fuser latches 100. Upon pulling open the access door 80, the hooks 131 of the door and hooks 133 of the fuser engage one another to rotate the fuser latches. In turn, the fusing nip (N) opens by widening a distance of separation (S) between the heated member 60 and backup member 65. In more detail, the latches have cams 105 (FIGS. 2 and 3) that when rotated about pivot 107 in the direction of action arrow A and push against surfaces 109 of the bellcranks. Since the bellcranks, as in FIG. 3, are generally L-shaped between orthogonal surfaces 110, 112, and are hinged at 114 by anchoring a tab 116 through a frame 120 of the fuser assembly, the bellcranks rotate in the direction of action arrow B. In turn, this rotation levers the nip loading springs 84 causing further compression of the springs in the direction of action arrow C thereby decreasing and eventually removing the bias of the spring from acting on the end caps 92 as the bellcranks move in the direction of action arrow D. Ultimately, this opens the fusing nip by separating the heated and backup members from one another (see, e.g., FIG. 5A, noting the spacing 145 in the close-up view interior to the fuser assembly 56 between the heated and backup members 60, 65).

Reversing the foregoing process, when the fuser latches 100 rotate in the direction of action arrow A', the cams 105 release pressure from surfaces 109 of the bellcranks 90 allowing the bellcranks to rotate in the direction of action arrow B'. In turn, the springs 84 exert pressure back in the direction of action arrow C' and the bellcranks act on the end caps 92 in the direction of action arrow D'. This closes the fusing nip.

Figure 4B:
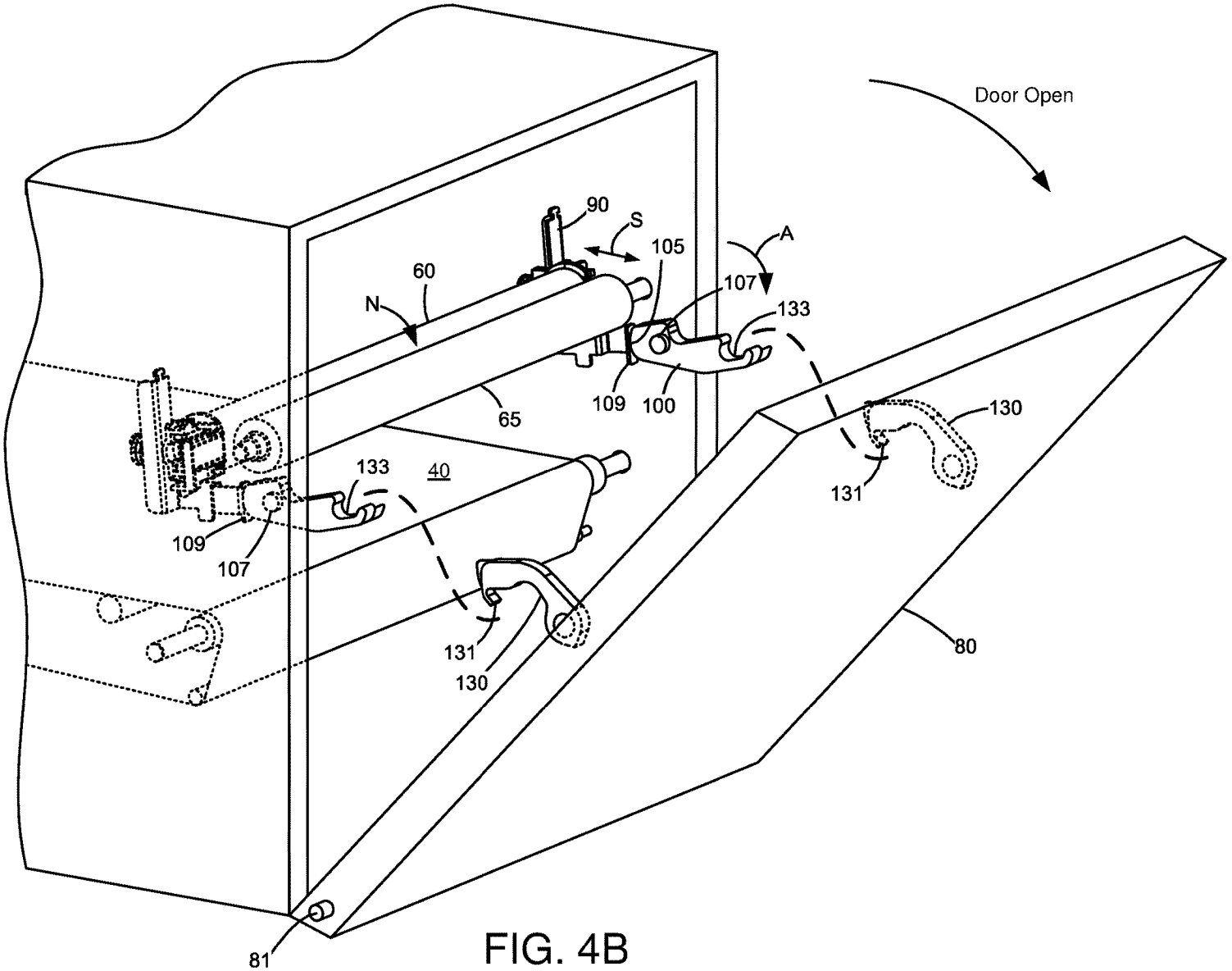
Figure 5A:
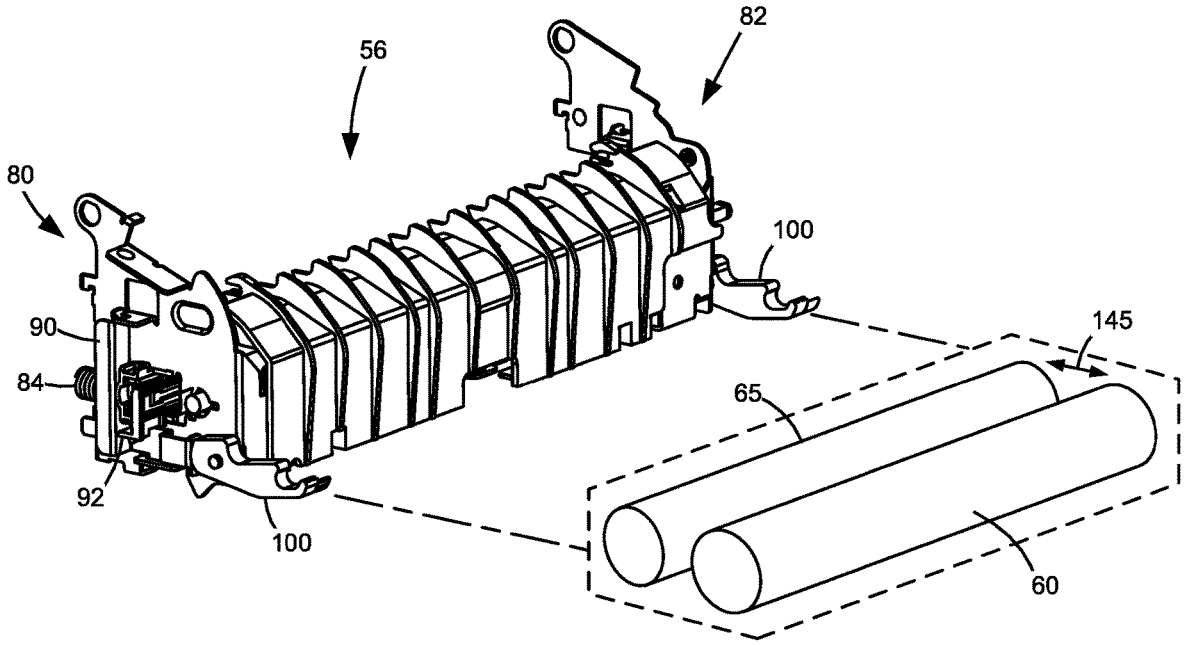
FIGS. 5A, 5B and 5C are diagrammatic views of a fuser assembly and conditions of the fusing nip depending upon positions of the rotatable latches.
Figure 5B:
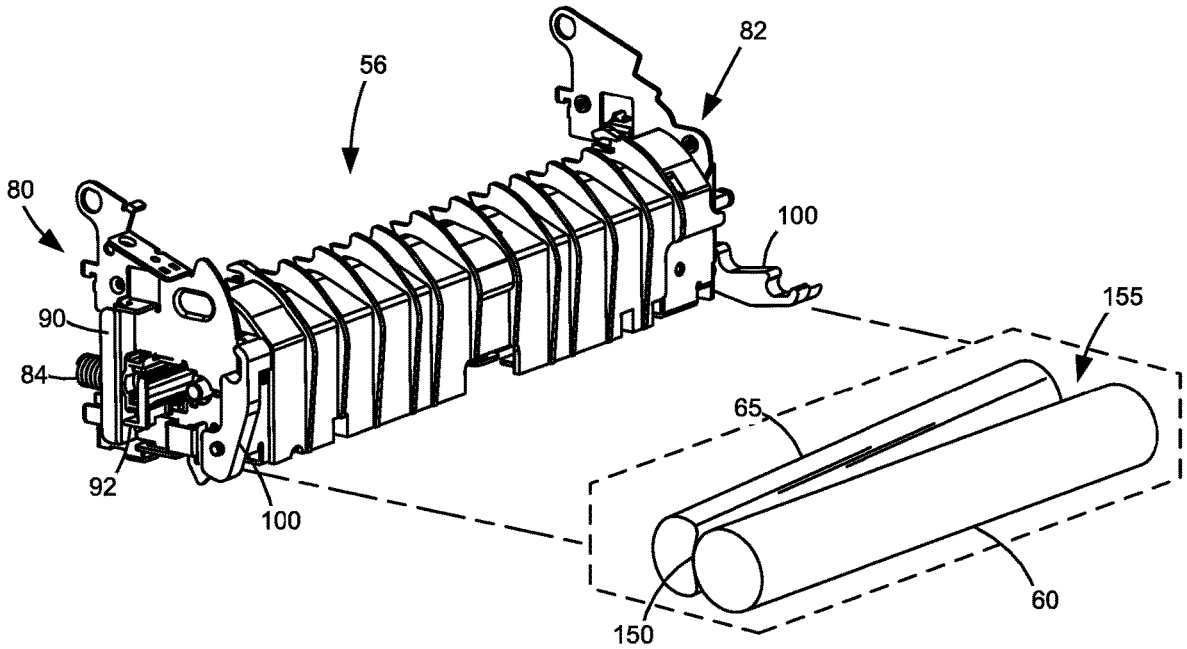
Figure 5C:
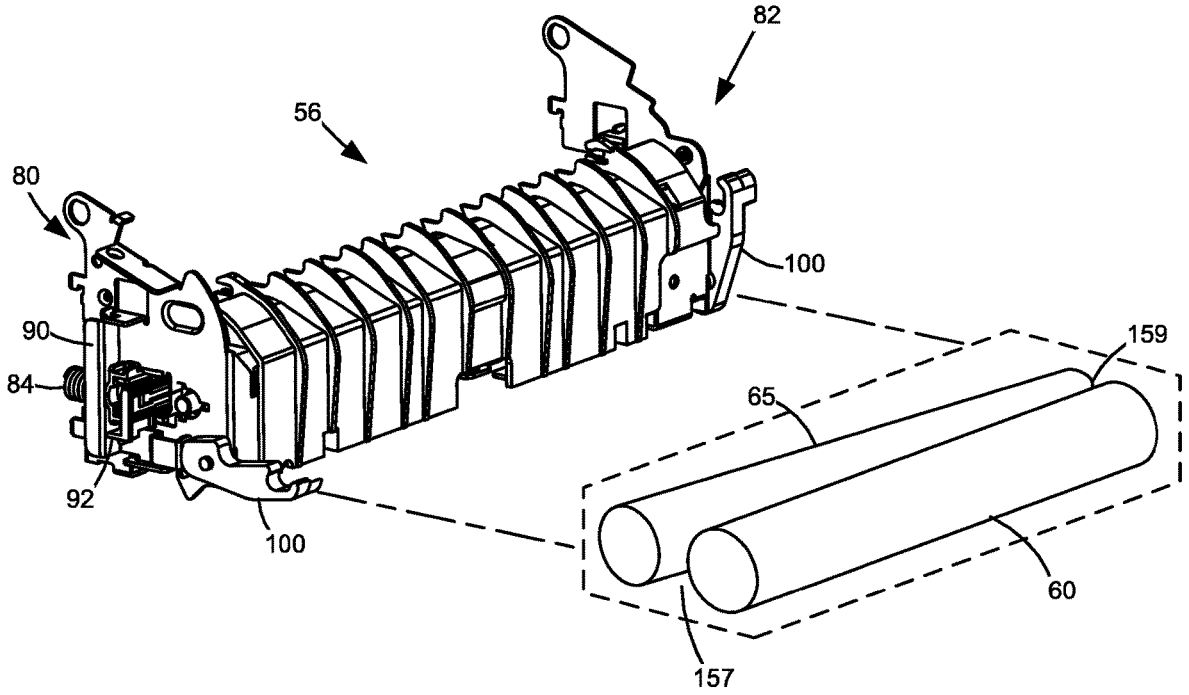

At this point, skilled artisans will appreciate that when the access door 80 is in the open position, e.g., FIG. 4B, users have access to an interior of the imaging device. As such, they also have access to the fuser latches and can manipulate them by hand open or closed. That each of the latches are independently operable, the latches may reside in different rotated positions from one another. With reference to FIGS. 5A-5C, the latches 100 are either both rotated to completely open the fusing nip or one latch at either the proximate or distal end 80, 82 of the fuser assembly 56 is rotated to asymmetrically close the fusing nip while the other is rotated to open it. In FIG. 5A, both latches 100 are rotated to entirely open the fusing nip as seen by the space 145 between the exaggerated view of the heated member 60 and backup member 65. In FIG. 5B, the latch at the distal end 82 is rotated to open the fusing nip at 155, whereas the latch at the proximate end 80 is rotated to keep closed the fusing nip at 150. Conversely, in FIG. 5C, the latch at the distal end 82 is rotated to close the fusing nip at 159, whereas the latch at the proximate end 80 is rotated to keep open the fusing nip at 157. Regardless of the position of the latches 100, the access door is still allowed to close whereby the door latches ride over the top of the fuser latches such that the hooks of the latches will again be able to engage one another upon opening of the door.

Figure 6A:
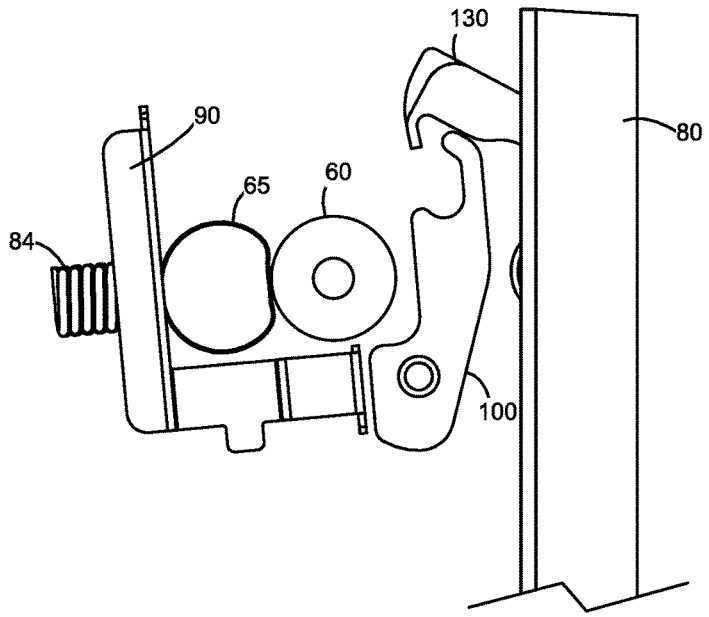
FIGS. 6A-6G are sequential views of the access door opening and then closing and movement of the rotatable latches of the fuser assembly and the latches of the door of the imaging device.
Figure 6B:
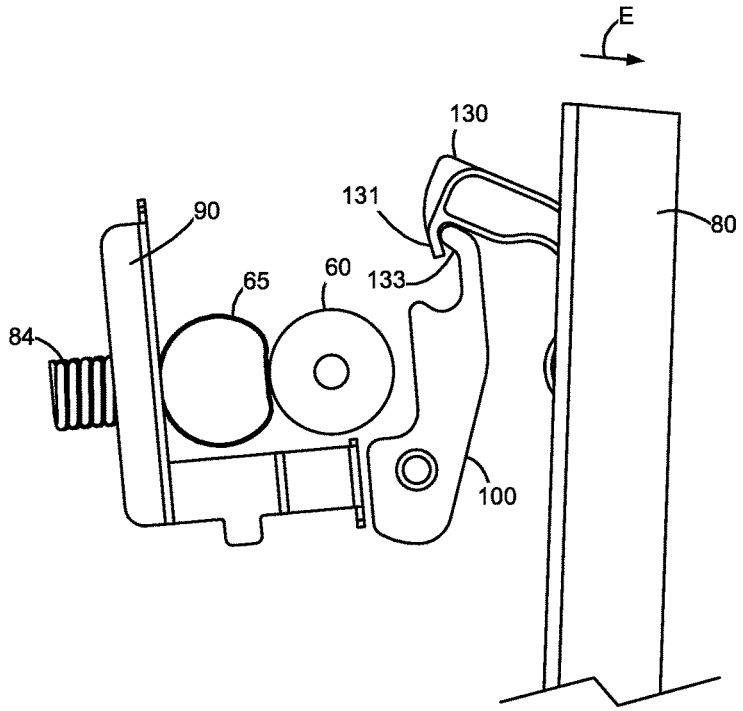
Figure 6C:
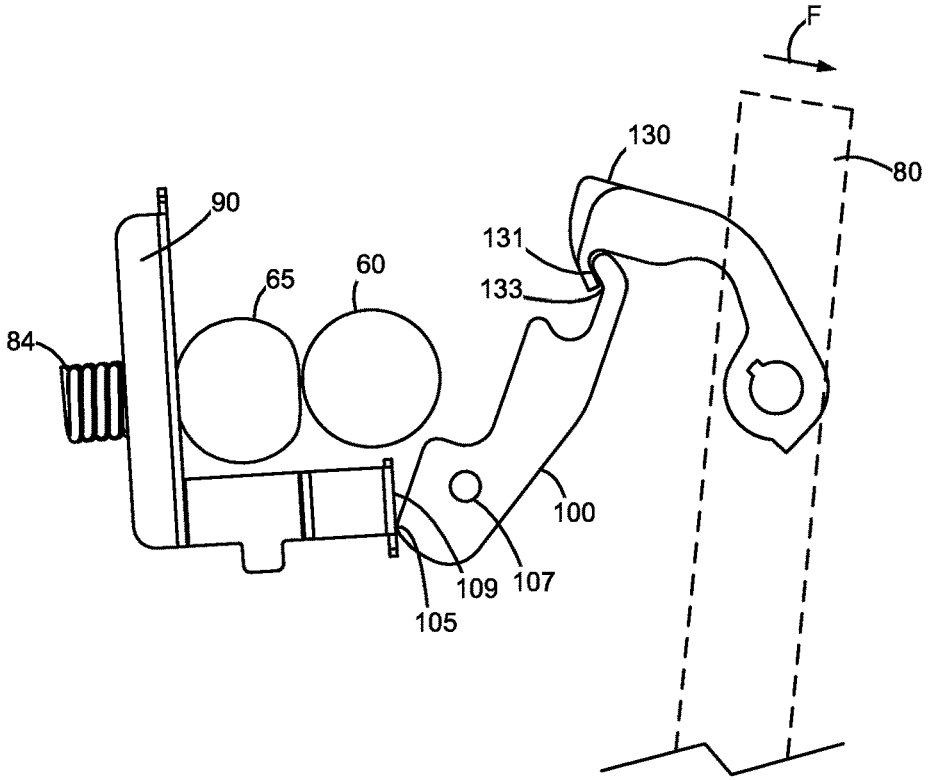
Figure 6D:
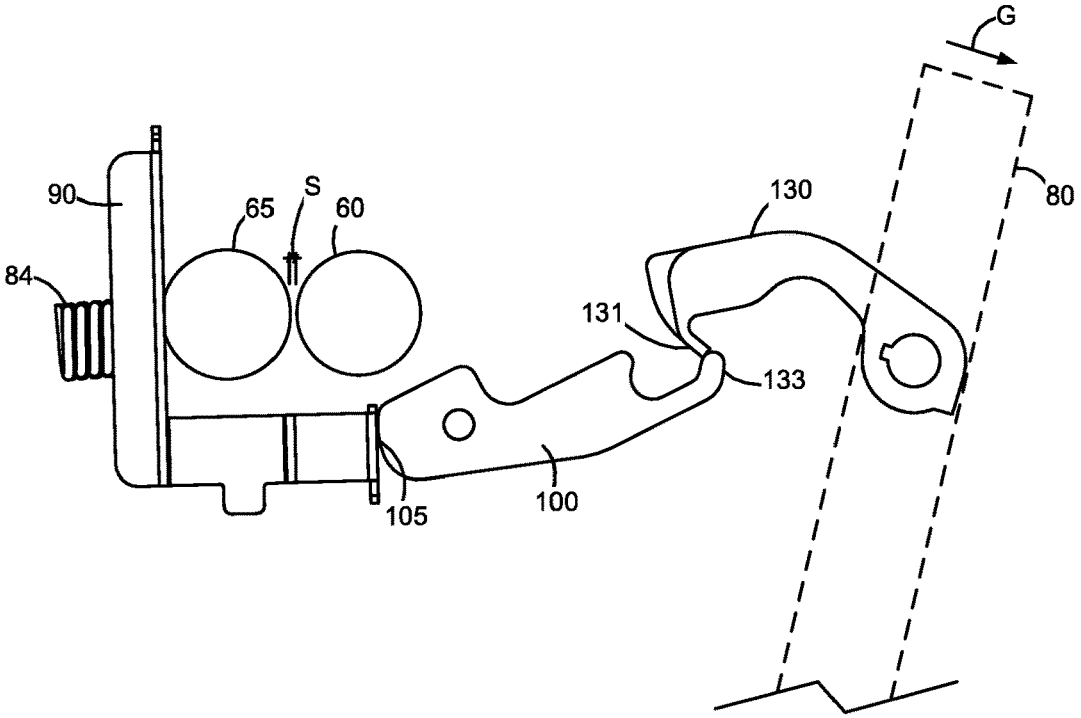
Figure 6E:
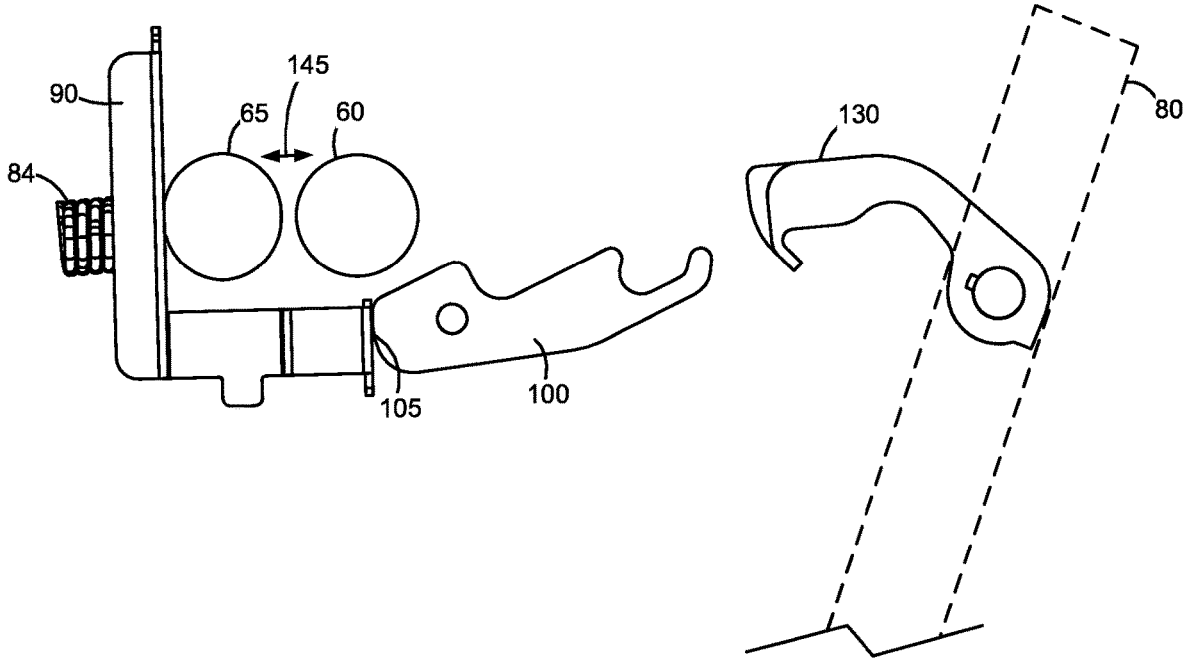
Figure 6F:
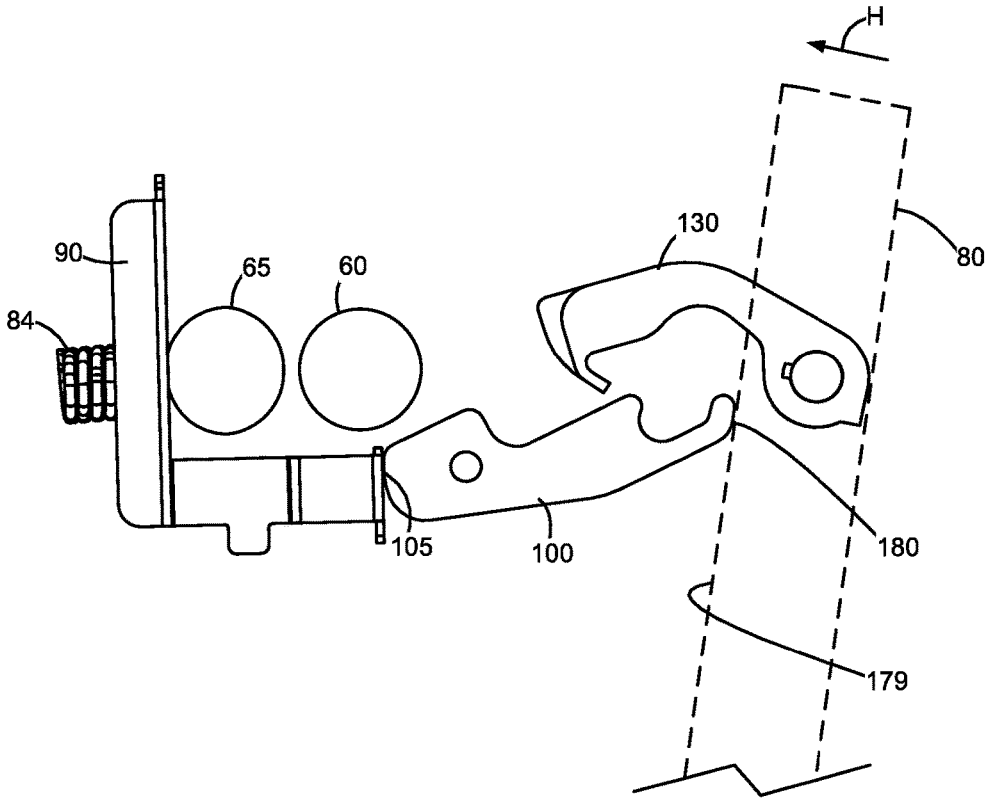
Figure 6G:
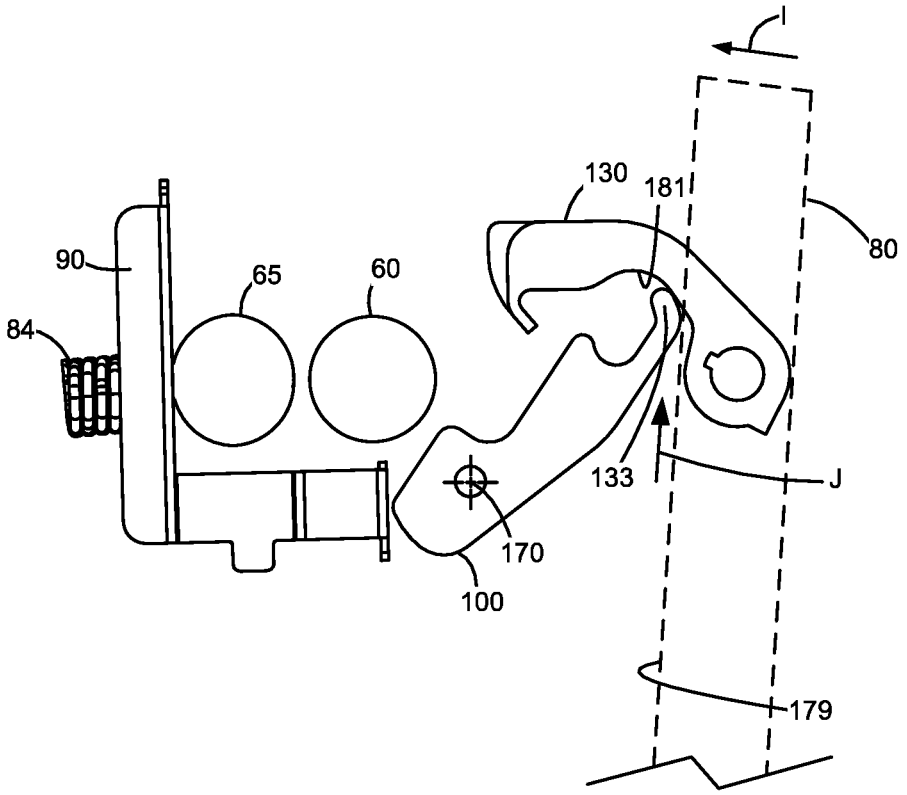

With reference to FIGS. 6A-6G. sequential movement of the door 80 is illustrated to note the movement of the latches 100, 130 relative to the fusing nip between the heated and backup members 65, 60. In FIG. 6A, the door 80 is closed. Upon slight movement of the door 80 in the direction of the Action Arrow E of FIG. 6B, the hooks 133, 131 of the latches 100, 130 engage one another. In FIG. 6C, further movement of the door 80 in the direction of Action Arrow F results in the rotation of the latch 100 about pivot point 107 such that the cam 105 begins engagement at surface 109 of the bellcrank 90. Continued movement of the door in the direction of Action Arrow G in FIG. 6D, further causes movement of the cam 106 against the bellcrank 90 and reveals the opening of the fusing nip at the distance of separation S between members 65, 60. In FIG. 6E, the door 80 is opened so far that the latches 100, 130 no longer engage one another and the fusing nip is fully opened at 145. In FIG. 6F, the door 80 begins closing in the direction of Action Arrow H such that an interior surface 179 of the door bumps against the rotatable latch 100 of the fuser assembly at contact point 180. In FIG. 6G, further movement of the door in the direction of Action Arrow I causes the latch 100 to rotate about pivot 107 and slide upward in the direction of Action Arrow J along the interior surface 179 of the door until the hook 133 engages the undersurface 181 of the door latch 130. Further movement causes the door latch 130 to rotate clockwise in this view until the door completely closes as in FIG. 6A.

The foregoing illustrates various aspects of the invention. It is not intended to be exhaustive. Rather, it is chosen to provide the best mode of the principles of operation and practical application known to the inventor so one skilled in the art can practice it without undue experimentation. All modifications and variations are contemplated within the scope of the invention as determined by the appended claims. Relatively apparent modifications include combining one or more features of one embodiment with those of other embodiments. Sill other modifications include imaging device configurations transferring toned images direct to media from the photoconductive drum instead of indirectly via an ITM.

The invention claimed is:

1. A fuser assembly having a longitudinal extent with a distal and proximate end for an imaging device having an access door, comprising:

a heated member oriented along the longitudinal extent;

a backup member oriented along the longitudinal extent;

at both the distal and proximate ends, a nip loading spring biased to press into contact the backup member and the heated member to form a fusing nip at which toner becomes fused to media during an imaging operation;

at both the distal and proximate ends, a bellcrank positioned in contact with a respective said nip loading spring; and at both the distal and proximate ends, a latch independently rotatable such that upon rotation the latch acts on the bellcrank to compress or relax said respective nip loading spring to open or close the fusing nip at a respective distal or proximate end of the fuser assembly, wherein the latch has a hook for being acted upon by a corresponding hook on a second latch on the access door of the imaging device.

2. The fuser assembly of claim 1, wherein the latch has a cam surface that causes rotation of the bellcrank upon rotation of the latch.

3. The fuser assembly of claim 1, wherein the latch at said distal and proximate ends reside in different rotated positions from one another but still allow closing of the access door of the imaging device.

4. The fuser assembly of claim 1, wherein the heated member is a belt having an end cap at each of the distal and proximate ends, the bellcrank at each of the distal and proximate ends contacting a respective said end cap.

5. The fuser assembly of claim 1, wherein the bellcrank at each of the distal and proximate ends is hinged to rotate into contact with said respective said nip loading spring upon being acted on by the latch.

6. The fuser assembly of claim 1, wherein either of said latches at the distal and proximate ends is rotated but not the other such that the fusing nip only opens at a corresponding end of the longitudinal extent.

7. The fuser assembly of claim 1, wherein the bellcrank has the nip loading spring acting on a first surface with an end cap acting on a surface opposite the first surface, the end cap inserting into a terminal end of the heated member.

8. The fuser assembly of claim 1, wherein the bellcrank is L-shaped, the nip loading spring acting on a first surface of the bellcrank while the latch acts on a second surface.

9. The fuser assembly of claim 1, further including a plate fixed to the fuser assembly to secure an end of each of the nip loading springs.

10. An imaging device for imaging sheets of media, comprising:

a door providing access to an interior of the imaging device, the door having two door latches each on either sides of the door; and a fuser assembly located in the interior to fuse toner to the sheets of media during use, the fuser assembly having, a heated member with a length of rotation, a backup member, two nip loading springs biased on either side of the length of rotation to press into contact the backup member and the heated member to form a fusing nip, two bellcranks each positioned on either side of the length of rotation in contact with either of the two nip loading springs, and two fuser latches each independently rotatable such that upon rotation said each fuser latch acts on a respective said bellcrank to compress or relax said respective nip loading spring to open or close the fusing nip at a respective distal or proximate end of the fuser assembly, wherein said each of the two fuser latches have a hook for being acted upon by a corresponding hook on a respective one of said two door latches.

11. The imaging device of claim 10, wherein said each of the two fuser latches has a cam surface that causes rotation of the two bellcranks upon rotation.

12. The imaging device of claim 10, wherein said each of the two fuser latches reside in different rotated positions from one another but still allow closing of the door of the imaging device.

13. The imaging device of claim 10, wherein the heated member is a belt having an end cap at each of the distal and proximate ends, said each of the two bellcranks contacting a respective end cap.

14. The imaging device of claim 10, wherein said each of the two bellcranks is hinged to rotate into contact with said two nip loading springs upon being acted upon by the two fuser latches.

15. The imaging device of claim 10, wherein either of said two fuser latches is rotated but not the other such that the fusing nip only opens at a corresponding end of the fusing nip.

16. The imaging device of claim 10, wherein the fuser assembly further includes a frame for hinging the two bellcranks.

17. The imaging device of claim 10, wherein the two bellcranks have a first surface acted upon by either of said two loading springs and a second surface acted upon by either of the two fuser latches.

18. The imaging device of claim 10, further including a plate to commonly secure an end of said each of the two nip loading springs.

19. The imaging device of claim 10, wherein the door is hinged to rotate open and closed.

20. A fuser assembly having a longitudinal extent with a distal and proximate end for an imaging device having an access door, comprising:

a heated member oriented along the longitudinal extent;

a backup member oriented along the longitudinal extent;

at both the distal and proximate ends, a nip loading spring biased to press into contact the backup member and the heated member to form a fusing nip at which toner becomes fused to media during an imaging operation;

at both the distal and proximate ends, a bellcrank positioned in contact with a respective said nip loading spring; and at both the distal and proximate ends, a latch independently rotatable such that upon rotation the latch acts on the bellcrank to compress or relax said respective nip loading spring to open or close the fusing nip at a respective distal or proximate end of the fuser assembly, wherein the latch at said distal and proximate ends reside in different rotated positions from one another but still allow closing of the access door of the imaging device.

21. A fuser assembly having a longitudinal extent with a distal and proximate end for an imaging device having an access door, comprising:

a heated member oriented along the longitudinal extent;

a backup member oriented along the longitudinal extent;

at both the distal and proximate ends, a nip loading spring biased to press into contact the backup member and the heated member to form a fusing nip at which toner becomes fused to media during an imaging operation;

at both the distal and proximate ends, a bellcrank positioned in contact with a respective said nip loading spring; and at both the distal and proximate ends, a latch independently rotatable such that upon rotation the latch acts on the bellcrank to compress or relax said respective nip loading spring to open or close the fusing nip at a respective distal or proximate end of the fuser assembly, wherein either of said latches at the distal and proximate ends is rotated but not the other such that the fusing nip only opens at a corresponding end of the longitudinal extent.

* * * * *